US006578214B2

(12) United States Patent
Peftoulidis

(10) Patent No.: US 6,578,214 B2
(45) Date of Patent: Jun. 17, 2003

(54) SPORT BEDS

(76) Inventor: Paula Peftoulidis, 84 Blue Ridge Dr., Humboldt, TN (US) 38343

( * ) Notice: Subject to any disclaimer, the term of this patent is extended or adjusted under 35 U.S.C. 154(b) by 140 days.

(21) Appl. No.: 09/801,160

(22) Filed: Mar. 7, 2001

(65) Prior Publication Data

US 2002/0124311 A1 Sep. 12, 2002

(51) Int. Cl.[7] ..... A47C 17/52; A47C 19/22

(52) U.S. Cl. ..... 5/308; 5/2.1; 5/905; D6/388; D6/506

(58) Field of Search ..... 5/308, 2.1, 53.1, 5/905, 907; D6/388, 506

(56) References Cited

U.S. PATENT DOCUMENTS

| | | | | | |
|---|---|---|---|---|---|
| 819,068 | A | * | 5/1906 | Ives | 5/905 X |
| D45,708 | S | * | 5/1914 | Giordano | 5/905 X |
| 1,297,144 | A | * | 3/1919 | Giordano | 5/2.1 |
| 1,500,057 | A | * | 7/1924 | Corns | 5/905 X |
| 1,754,937 | A | * | 4/1930 | Comstock | 5/636 |
| 1,991,111 | A | * | 2/1935 | Murrell | 5/905 X |
| D120,222 | S | * | 4/1940 | Harman | D6/358 |
| D147,942 | S | | 11/1947 | Ziegler | D6/388 |
| 2,462,524 | A | * | 2/1949 | Mattedi | 5/308 |
| D159,009 | S | * | 6/1950 | Sharp | 5/308 |
| D178,668 | S | * | 9/1956 | Jensen | D6/506 |
| 2,787,007 | A | * | 4/1957 | Erdkamp | 5/2.1 |
| 3,338,648 | A | * | 8/1967 | Bannister | 312/195 |
| D233,381 | S | * | 10/1974 | Wright | D6/351 |
| D234,730 | S | * | 4/1975 | De La Vega | D6/358 |
| D247,727 | S | * | 4/1978 | Mitchell | D6/388 |
| D248,262 | S | * | 6/1978 | Robichaud | D6/506 |
| D248,346 | S | * | 7/1978 | Robichaud | D6/506 |
| D252,598 | S | | 8/1979 | Carter | D6/388 |
| D252,599 | S | | 8/1979 | Carter | D6/388 |
| D252,602 | S | * | 8/1979 | Cirrone | D6/358 |
| D252,608 | S | | 8/1979 | Carter | D6/388 |
| 4,259,755 | A | * | 4/1981 | Hollander | 5/308 X |
| D260,468 | S | * | 9/1981 | Huebner | D6/597 |
| D275,912 | S | | 10/1984 | Hydrusko et al. | D6/388 |
| D279,430 | S | * | 7/1985 | McLeroy | D6/358 |

(List continued on next page.)

FOREIGN PATENT DOCUMENTS

| | | | | |
|---|---|---|---|---|
| GB | 166413 | * | 9/1921 | 5/308 |
| GB | 352683 | * | 7/1931 | 5/308 |
| GB | 2200541 A | * | 8/1988 | 5/53.1 |

*Primary Examiner*—Robert G. Santos
(74) *Attorney, Agent, or Firm*—Michael I. Kroll

(57) ABSTRACT

The present invention 10 discloses various sport-shaped bed designs consisting of a frame 26, mattress 14, motion sensors 32, rechargeable battery cell 36 and dimmer night light 42. The designs have shapes such as a football, baseball, soccer, basketball, and other sport shapes. The bed also comprises storage drawers 28 located in various positions according to the design. Each bed contains battery-operated motion sensors 32 which trigger a night dimmer light 42. When the sensor 32 indicates a child has laid down in the bed, the dimmer 42 responds to the signal and the light 18 goes on. Within a short period of time, the light slowly dims until it is fully out. If the child 12 should sit up, the sensor 32 will react and the light 18 will go on. The mattress 14 fits down inside a recess 16 in the frame 26 and the headboard 20.

12 Claims, 10 Drawing Sheets

U.S. PATENT DOCUMENTS

| | | | | | |
|---|---|---|---|---|---|
| D292,758 | S | | 11/1987 | Bethune | D6/388 |
| 4,780,919 | A | * | 11/1988 | Harrison | 5/308 X |
| 4,873,733 | A | | 10/1989 | Wang | 5/98.1 |
| 5,182,824 | A | | 2/1993 | Cipriano | 5/2.1 |
| 5,184,360 | A | | 2/1993 | Gonzalez | 5/2.1 |
| 5,189,393 | A | * | 2/1993 | Hu | 340/522 |
| D344,863 | S | | 3/1994 | Winkier | D6/388 |
| D356,900 | S | | 4/1995 | Chesmore | D6/388 |
| D359,866 | S | | 7/1995 | Duprey | D6/506 |
| D364,510 | S | * | 11/1995 | Harrison | D6/388 |
| D373,258 | S | * | 9/1996 | Egbers | D6/388 |
| D384,830 | S | | 10/1997 | Daniel | D6/388 |
| 5,690,379 | A | | 11/1997 | Cayssials | 297/118 |
| 5,765,239 | A | * | 6/1998 | Moses | 5/2.1 |
| D411,696 | S | * | 6/1999 | Sorrell | D6/388 |
| 5,950,257 | A | * | 9/1999 | Smith et al. | 5/2.1 |
| D424,823 | S | * | 5/2000 | Taylor et al. | D6/358 |
| 2002/0124311 | A1 | * | 9/2002 | Peftoulidis | 5/308 |
| 2002/0126475 | A1 | * | 9/2002 | Washburn | 362/130 |

* cited by examiner

SPORT BEDS

BACKGROUND OF THE INVENTION

1. Field of the Invention

The present invention relates generally to sports beds and more specifically to ornamental bed designs depicting sports. The present invention consists of various sport shaped bed designs consisting of a frame, mattress, motion sensors, rechargeable battery cell and dimmer night light. The designs mimic sports activities such as football, baseball, soccer, basketball, and other sports shapes. The bed designs of the present invention consist of storage drawers located in various positions according to design. The bed designs of the present invention are focused toward toddler and youth use. Each bed unit contains battery operated motion sensors which trigger a night dimmer light. When the sensor indicates a child has lain down in the bed, the dimmer light responds to the signal and the light goes on. Within a short period of time, the light slowly dims until it is fully out. If the child should sit up, the sensor will react and the light will go on. The mattress of the present invention fits down inside the frame and the headboard. The headboard extends up a wall at an angle to give the appearance of the mattress within the sport design. The bed and mattress may come in various sizes. The bed designs of the present invention are made of a durable plastic and are easy to clean. They are fire resistant and child safe.

2. Description of the Prior Art

There are other sports bed designed to improve a child's sleeping quarters. Typical of these is U.S. Pat. No. 147,942 issued to Ziegler on Jan. 3, 1946.

Another patent was issued to Carter on Aug. 14, 1979 as U.S. Pat. No. 252,598. Yet another U.S. Pat. No. 252,599 was issued to Carter on Aug. 14, 1979 and still yet another was issued on Oct. 16, 1984 to Hydrusko et al. as U.S. Pat. No. 275,912.

Another patent was issued to Bathune et al on Nov. 17, 1987 as U.S. Pat. No. 292,758. Another patent was issued to Winkler et al on Mar. 8, 1994 as U.S. Pat. No. 344,863. Another patent was issued to Chesmore et al on Apr. 4, 1995 as U.S. Pat. No. 356,900. Another patent was issued to Duprey et al on Jul. 4, 1995 as U.S. Pat. No. 359,866. Another patent was issued to Daniel et al on Oct. 14, 1997 as U.S. Pat. No. 384,830.

Another patent was issued to Wang et al on Oct. 17, 1989 as U.S. Pat. No. 4,873,733. Another patent was issued to Cipriano et al on Feb. 2, 1993 as U.S. Pat. No. 5,182,824. Another patent was issued to Gonzalez et al on Feb. 9, 1993 as U.S. Pat. No. 5,184,360. Another patent was issued to Cayssials et al on Nov. 25, 1997 as U.S. Pat. No. 5,690,379.

U.S. Pat. No. 147,942

Inventor: F. Ziegler

Issued: Jan. 3, 1946

The ornamental design for a bedstead, as shown and described.

U.S. Pat. No. 252,598

Inventor: Virgil Carter

Issued: Aug. 14, 1979

The ornamental design for a child's bed, substantially as shown and described.

U.S. Pat. No. 252,599

Inventor: Virgil Carter

Issued: Aug. 14, 1979

The ornamental design for a child's bed, substantially as shown and described.

U.S. Pat. No. 252,608

Inventor: Virgil Carter

Issued: Aug. 14, 1979

The ornamental design for a child's bed, substantially as shown and described.

U.S. Pat. No. 275,912

Inventor: Lawrence P. Hydrusko

Issued: Oct. 16, 1984

The ornamental design for a child's bed, as shown and described.

U.S. Pat. No. 344,863

Inventor: Mark S. Winkler

Issued: May 8, 1994

The ornamental design for a baseball bed frame, as shown and described.

U.S. Pat. No. 356,900

Inventor: Victor Chesmore

Issued: Apr. 4, 1995

The ornamental design for a baseball bed, as shown and described.

U.S. Pat. No. 359,866

Inventor: Michael Duprey

Issued: Jun. 4, 1995

The ornamental design for a children's football helmet bed, as shown and described.

U.S. Pat. No. 384,830

Inventor: William Daniel

Issued: Oct. 14, 1997

The ornamental design for a baseball bed, as shown and described.

U.S. Pat. No. 4,873,733

Inventor: Ted Wang

Issued: Oct. 17, 1989

This invention concerns a new toy bed which is made to have a shape mimicking that of a practical object, such as a locomotive, a car, a ship, a tank, etc., to arouse a child's curiosity. For example, when it has a shape of a locomotive, it consists of three main parts, a frame, a mattress and a cover. The frame is assembled with tubes and joints, having a shape mimicking that locomotive, and the mattress is placed in the frame and surrounded by the framework, so that the frame can steadily be stabilized on the ground. The cover, made of a kind of soft material and having the same shape as the frame, is finally placed around the frame to complete this bed.

U.S. Pat. No. 5,182,824

Inventor: Nickolas Cipriano

Issued: Feb. 2, 1993

A wrestling bed provides a defined and restricted area for children's vigorous activities, thus serving to protect other articles from accidental damage due to such vigorous play. The wrestling bed is solidly constructed in order to resist damage from active play, which might damage standard bed frames. The wrestling bed includes a platform sized to provide a central area fitting a mattress of standard configuration and includes peripheral tread pads, corner posts and padding, peripheral ropes, and steps at one side of the platform. The wrestling bed has the general appearance of a wrestling or boxing ring, thereby lending some realism to children's wrestling or play therein, while providing copious padding and protection for children playing therein. The mattress, although substantially softer and more resilient than a real wrestling ring surface, provides greater protection and further doubles as a standard bedding mattress. A protective cover may be tucked in around the edges of the mattress for play, or the wrestling bed may be made up in the manner of a standard bed for sleep. The protective cover may be left in place beneath the standard bedding in order to protect the mattress in the event of incontinence.

U.S. Pat. No. 5,184,360

Inventor: Marta Gonzalez

Issued: Feb. 9, 1993

A platform bed assembly, to be used by a child as a sleeping area and a play area, the bed assembly includes a lower base structure structured and disposed to resemble a large scale version of a toy article such as a van or house. The platform bed assembly includes a mattress support platform positioned and secured atop the base structure whereon a mattress may be placed in overlying position, thereby defining a sunken sleeping area, includes a ladder secured to the base structure so as to allow facilitated access to the sleeping area, and includes a door in a side wall of the base structure to allow access to an interior compartment defining the play area. Additionally, there are a plurality of toy accessory components positioned within the interior compartment which correspond the design of the toy article, and add realism to the play environment.

U.S. Pat. No. 5,690,379

Inventor: Theresa Cayssial

Issued: Nov. 25, 1997

A decorative furniture item which a user may selectively move into a first arrangement for use as a stationary chair/step stool or into a second arrangement as a rocking chair. The transformation from one use to the other use is easily accomplished by the user turning the furniture item to the desired position. The decorative furniture item symbolizes a particular theme, such as a sport, a bird, an animal and the like. In one sport theme, the furniture item resembles two footballs supporting a chair structural arrangement. In other embodiments, the arrangements relate to a sport theme for baseball, tennis or golf. In another embodiment, the arrangement has a duck appearance. Each of the various structural arrangements constitute a readily assembled kit.

SUMMARY OF THE PRESENT INVENTION

The present invention discloses various sport-shaped bed designs consisting of a frame, mattress, motion sensors, rechargeable battery cell and dimmer night light. The designs have shapes such as a football, baseball, soccer, basketball, and other sport shapes. The bed also comprises storage drawers located in various positions according to the design. Each bed contains battery-operated motion sensors which trigger a night dimmer light. When the sensor indicates a child has laid down in the bed, the dimmer responds to the signal and the light goes on. Within a short period of time, the light slowly dims until it is fully out. If the child should sit up, the sensor will react and the light will go on. The mattress fits down inside a recess in the frame and the headboard.

A primary object of the present invention is to provide a line of sports bed designs.

Another object of the present invention is to provide a sports bed that mimic a particular sport such as baseball, football, soccer, basketball and many other sports.

Yet another object of the present invention is to provide a sports bed that consists a monitor and dimmer light within the headboard of each bed design.

Still yet another object of the present invention is to provide a sports bed that may be equipped with a variety of mattress sizes. Yet another object of the present invention is to provide a sports bed consisting storage drawers located in various locations according to the design of each.

Yet another object of the present invention is to provide a sports bed constructed from a durable plastic.

Additional objects of the present invention will appear as the description proceeds.

The present invention overcomes the shortcomings of the prior art by providing a line of sports bed designs. To provide a sports bed that mimic a particular sport such as baseball, football, soccer, basketball and many other sports. To provide a sports bed that consists a monitor and dimmer light within the headboard of each bed design. To provide a sports bed that may be equipped with a variety of mattress sizes. To provide a sports bed consisting storage drawers located in various locations according to the design of each. Yet another object of the present invention is to provide a sports bed constructed from a durable plastic.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claim.

LIST OF REFERENCE NUMERALS

Figure 1:
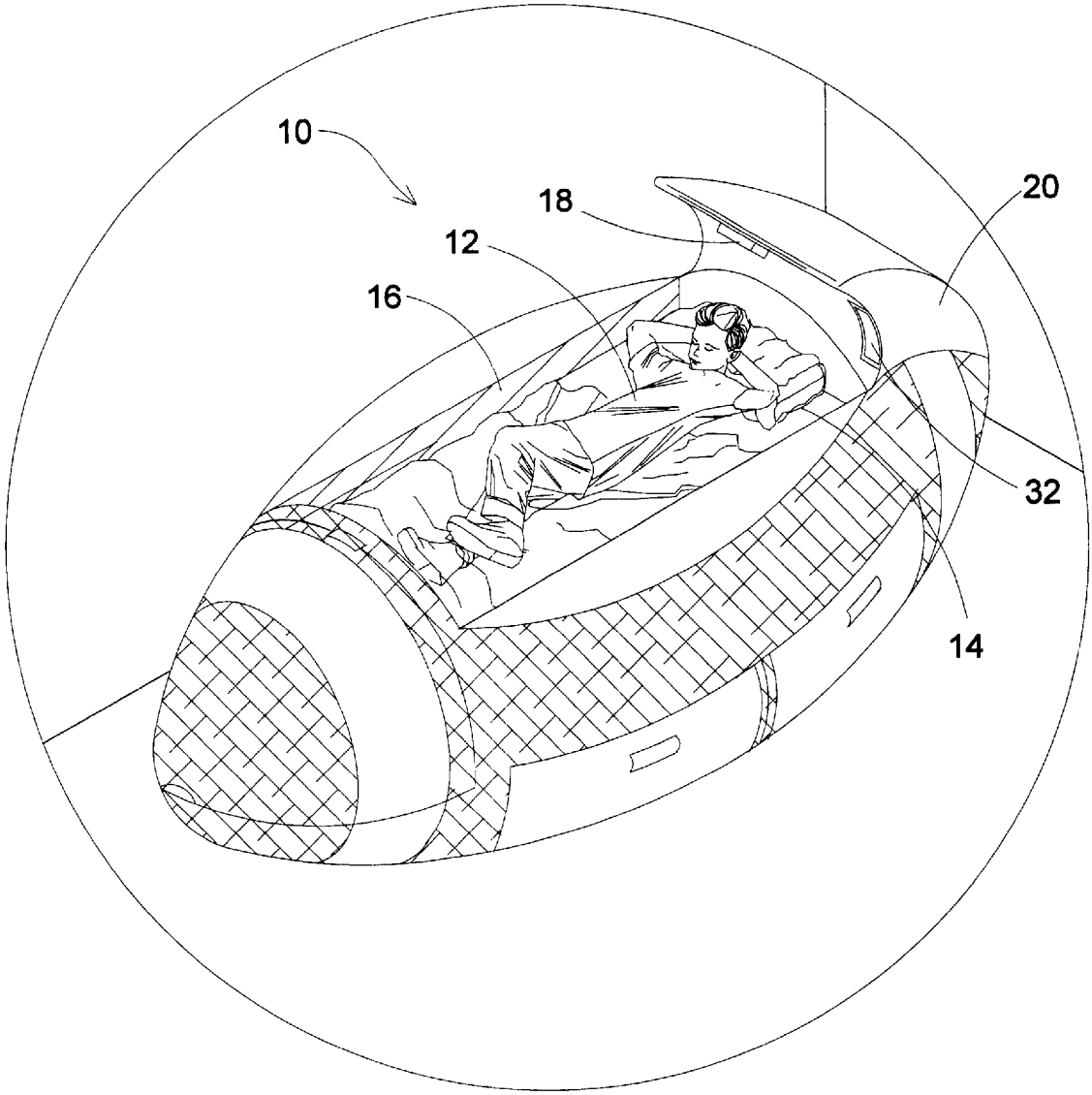
FIG. 1 is an isometric view of the present invention.

With regard to reference numerals used, the following numbering is used throughout the drawings.

10 present invention
12 child
14 mattress
16 recess
18 light
20 headboard
22 blanket
24 pillow
26 bed frame
27 support frame members
28 drawers
30 nose compartment
32 motion sensors
34 hinge
36 battery
38 logo
40 lid for nose compartment
42 dimmer
44 rear compartment
46 lid for rear compartment

DESCRIPTION OF THE PREFERRED EMBODIMENT(S)

In order that the invention may be more fully understood, it will now be described, by way of example, with reference to the accompanying drawings in which FIGS. 1 through 10 illustrate the present invention being a sports bed.

Turning to FIG. 1, shown therein is an isometric view of the present invention 10 showing a possible design of the sports bed with a child 12 sleeping on the bed on top of a mattress 14 resting within the recess 16 provided displaying the placement of a light 18 and a sensor 32 to activate the light as provided by the headboard 20.

Figure 2:
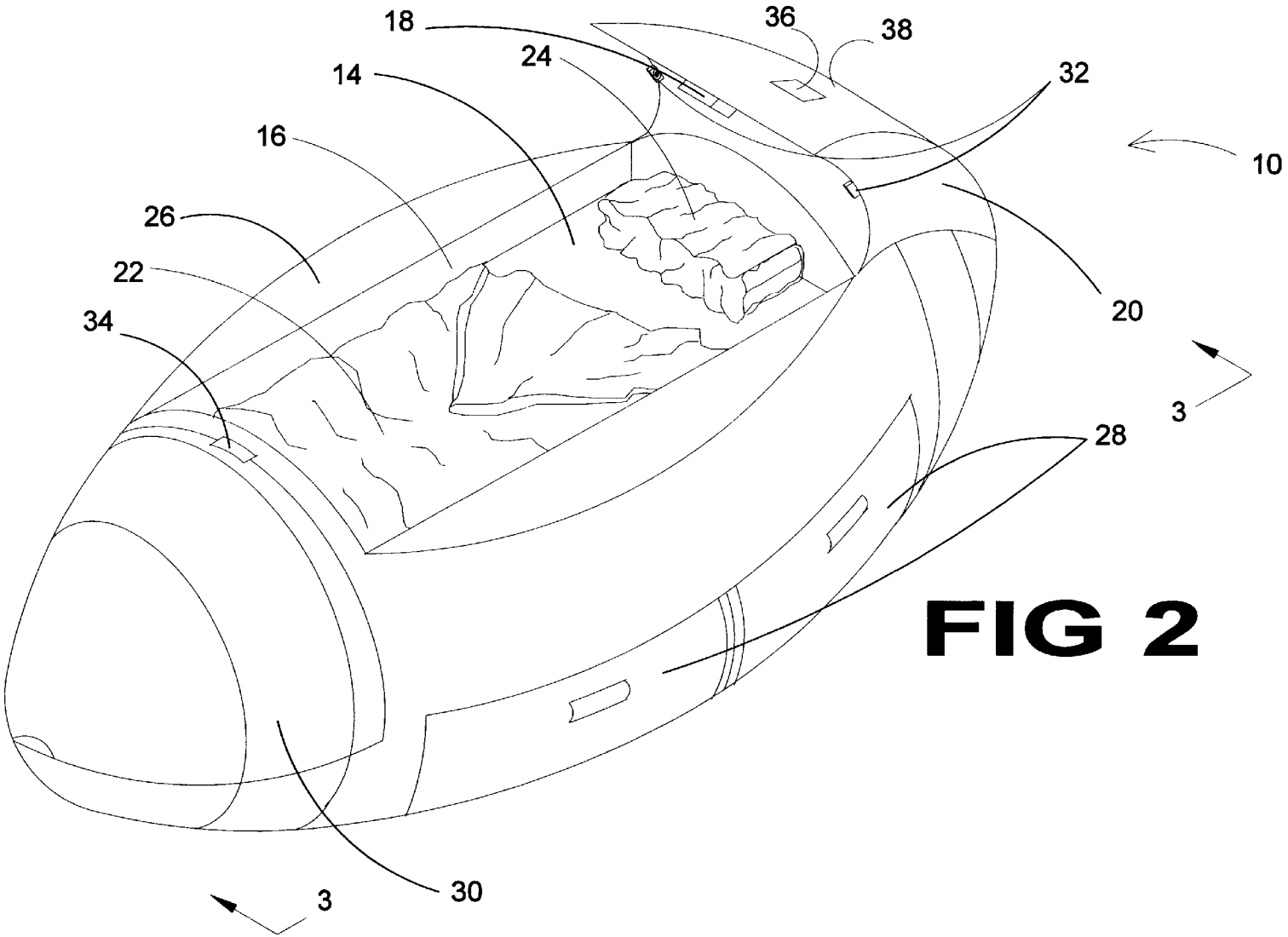
FIG. 2 is an isometric view of the present invention.

Turning to FIG. 2, shown therein is an isometric view of the present invention 10 showing the sports bed with a blanket 22, pillow 24 and mattress 14 placed within the recess 16 provided by the molded bed frame 26 which forms an enclosure, also showing the placement of storage compartments or drawers 28 for items a child may possess. Also shown are a storage compartment or toy box 30 with hinge 34 on the front nose of the bed frame 26, a headboard 20, motion sensors 32, night light 18, a rechargeable battery cell 36 and a place for a football team logo 38.

Figure 3:
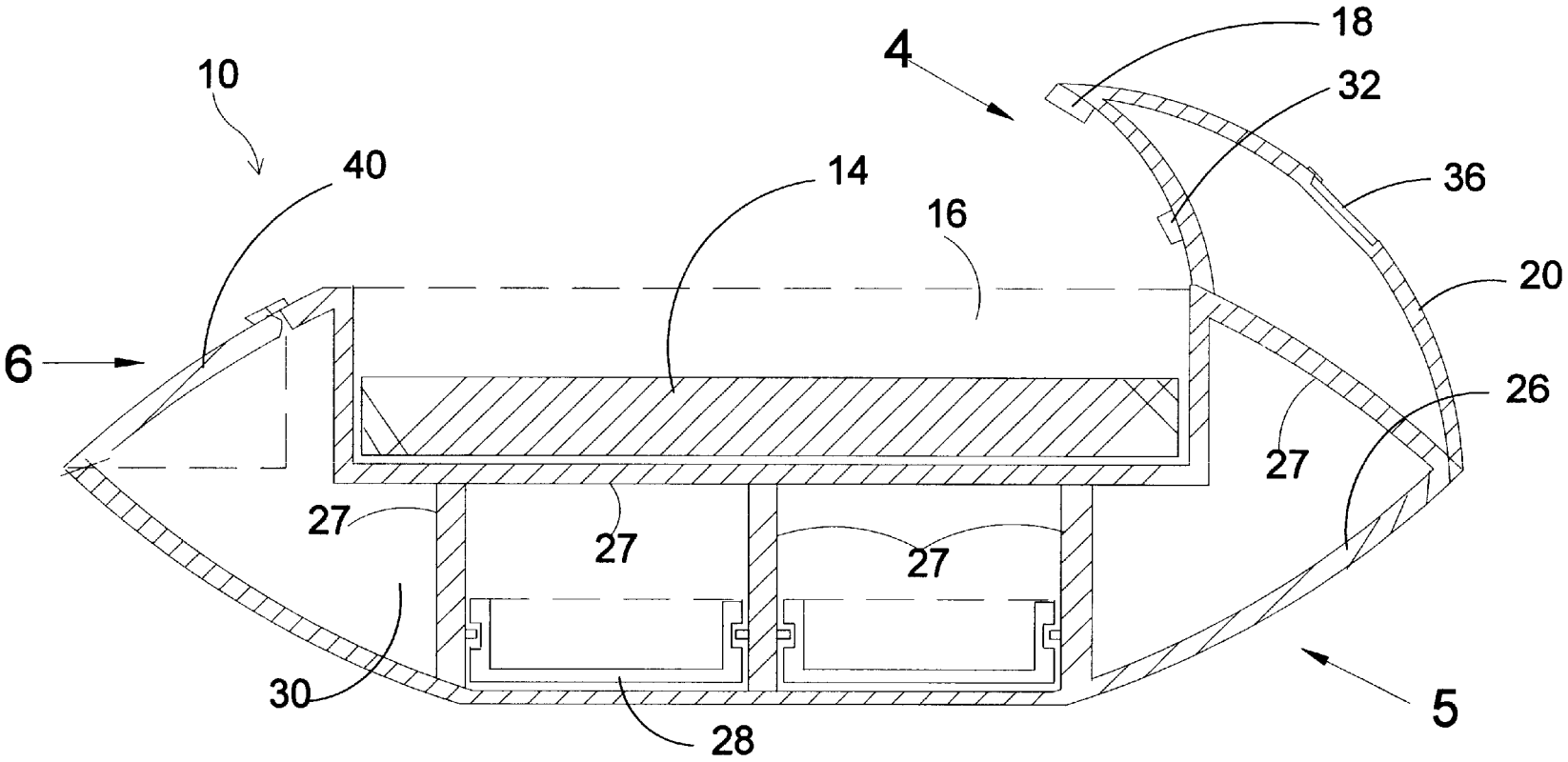
FIG. 3 is a cross section view of the present invention.

Turning to FIG. 3, shown therein is a cross section of the present invention 10 showing placement of multiple storage compartments 28, 30 for items a child may possess and the location of the main components that comprise the unit as previously disclosed along with a lid 40 for the nose compartment. Slidable storage drawers 28 are also shown. Multiple support frame members 27 are also shown.

Figure 4:
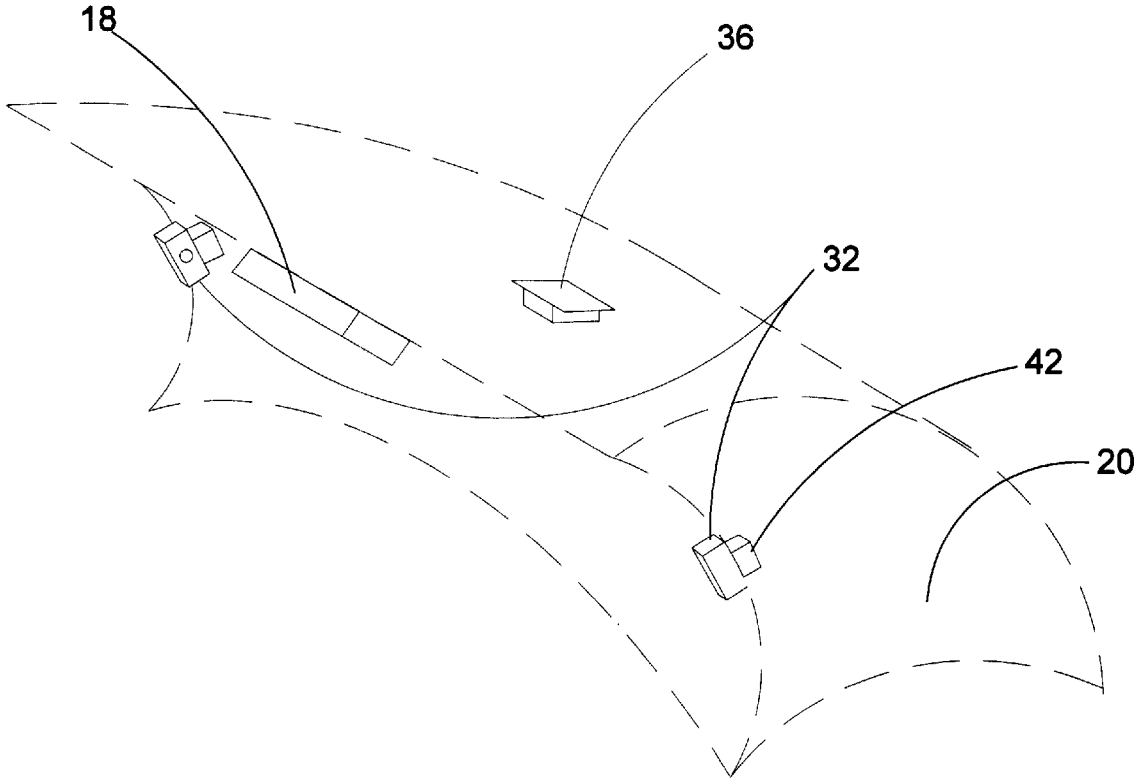
FIG. 4 is an isometric view of the head board components.

Turning to FIG. 4, shown therein is an isometric view of the headboard 20 components, showing the placement of all components housed within the headboard body. Also the presence of a dimmer unit 42 to slowly dim the night light 18 till no power is administered to the light after activation from the motion sensor 32.

Figure 5:
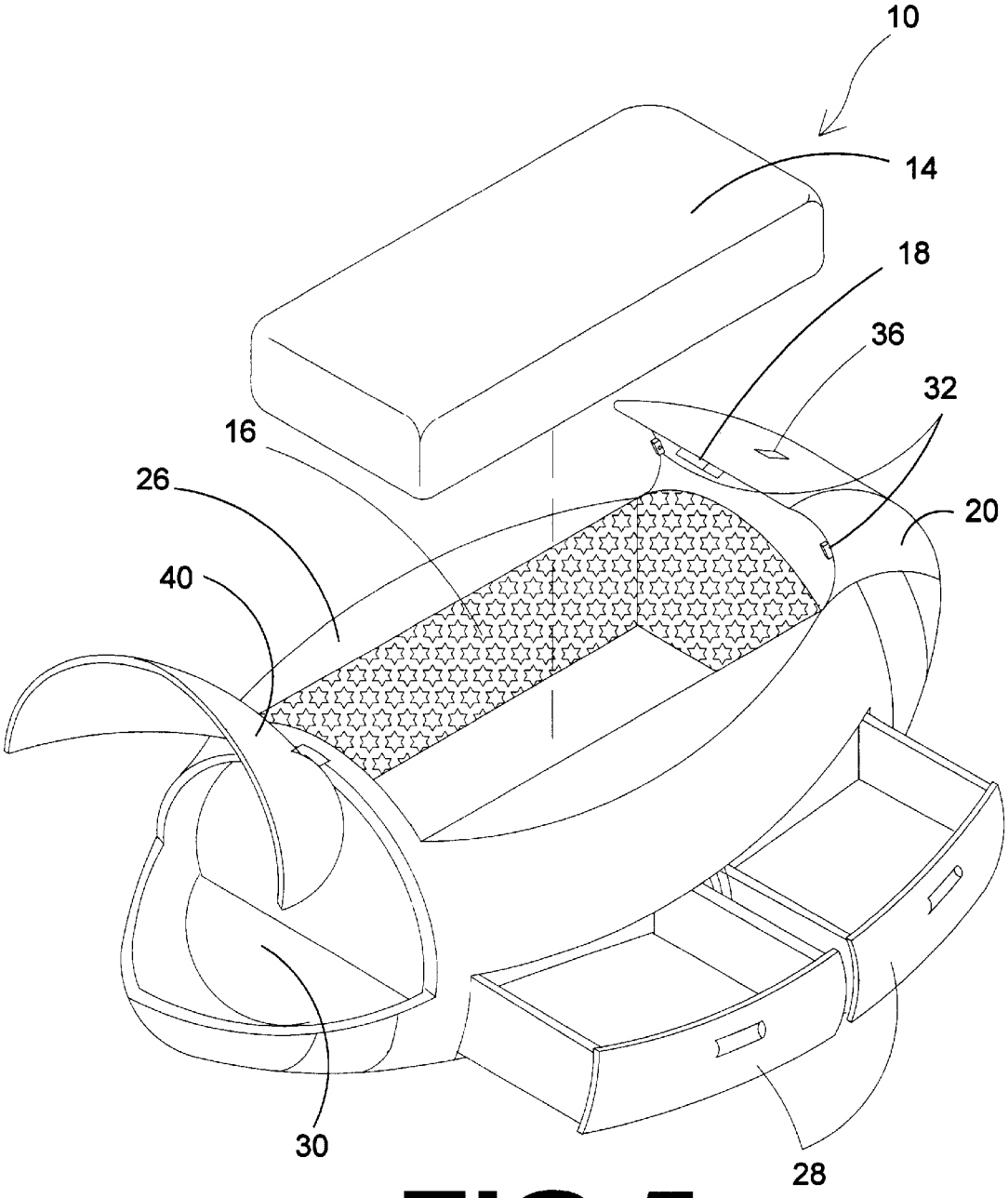
FIG. 5 is an isometric view of the present invention.

Turning to FIG. 5, shown therein is an isometric view of the present invention 10 showing the way in which a mattress 14 can be placed in the recessed area 16 provided by the molded bed frame 26 and the storage drawers 28 and storage compartment lid 40 in the open position ready for items to be placed within. Elements previously disclosed are also shown.

Figure 6:
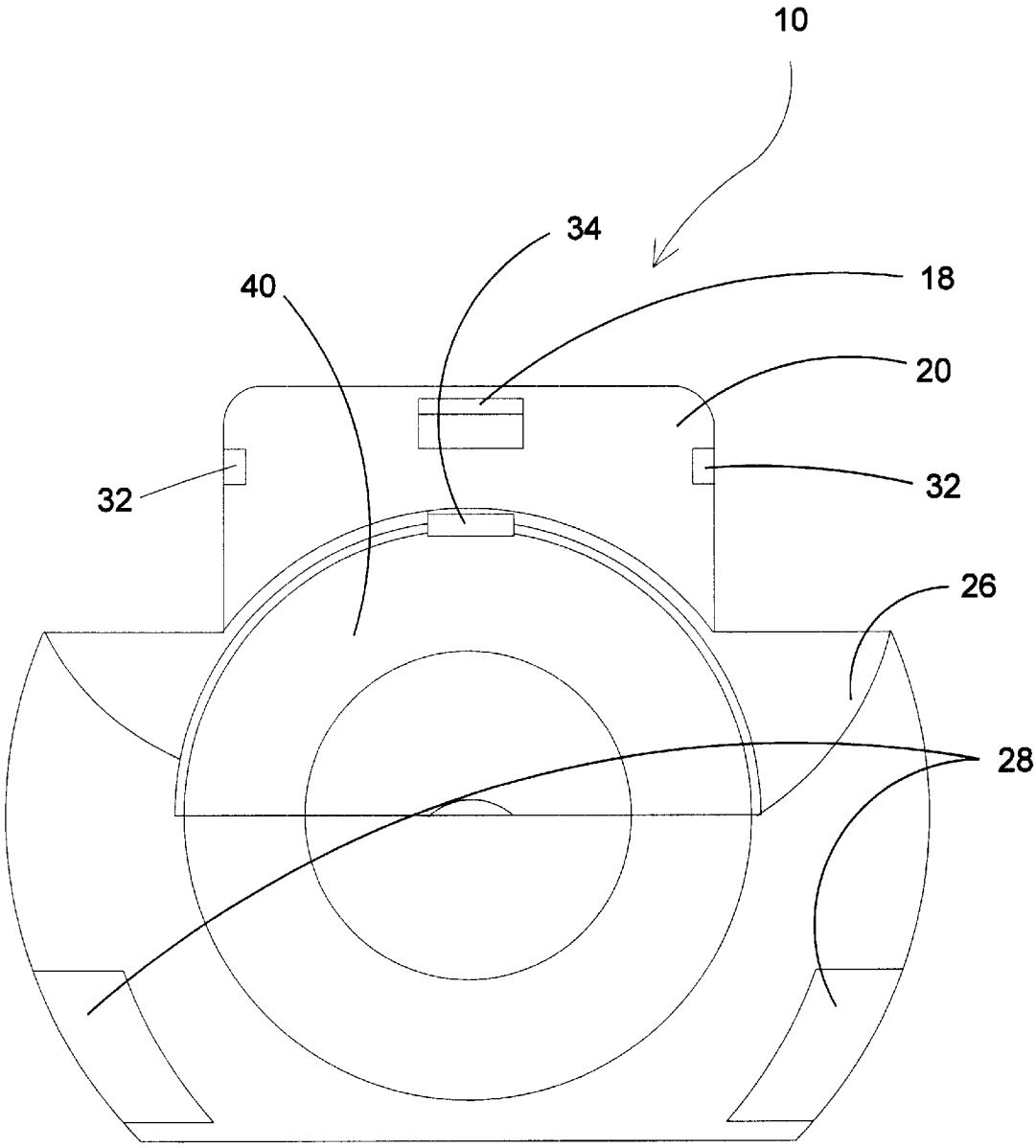
FIG. 6 is a frontal view of the present invention.

Turning to FIG. 6, shown therein is a frontal view of the present invention 10 showing the placement of components which have been previously disclosed in relation to the housing.

Figure 7:
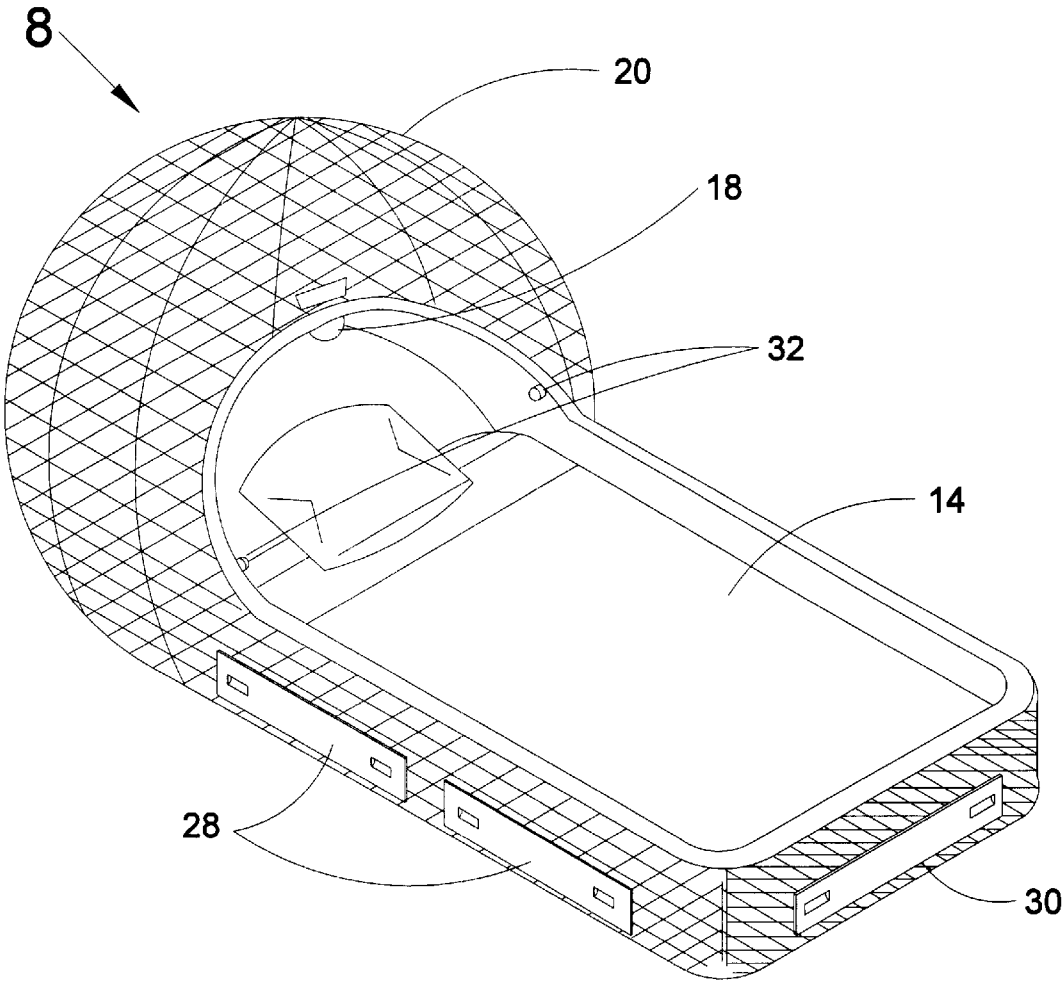
FIG. 7 is an isometric view of an alternate design.

Turning to FIG. 7, shown therein is an isometric view of the second design showing an alternate design for the sports bed, the design being a basketball. Shown are the elements of this design which are comparable to the previously disclosed elements.

Figure 8:
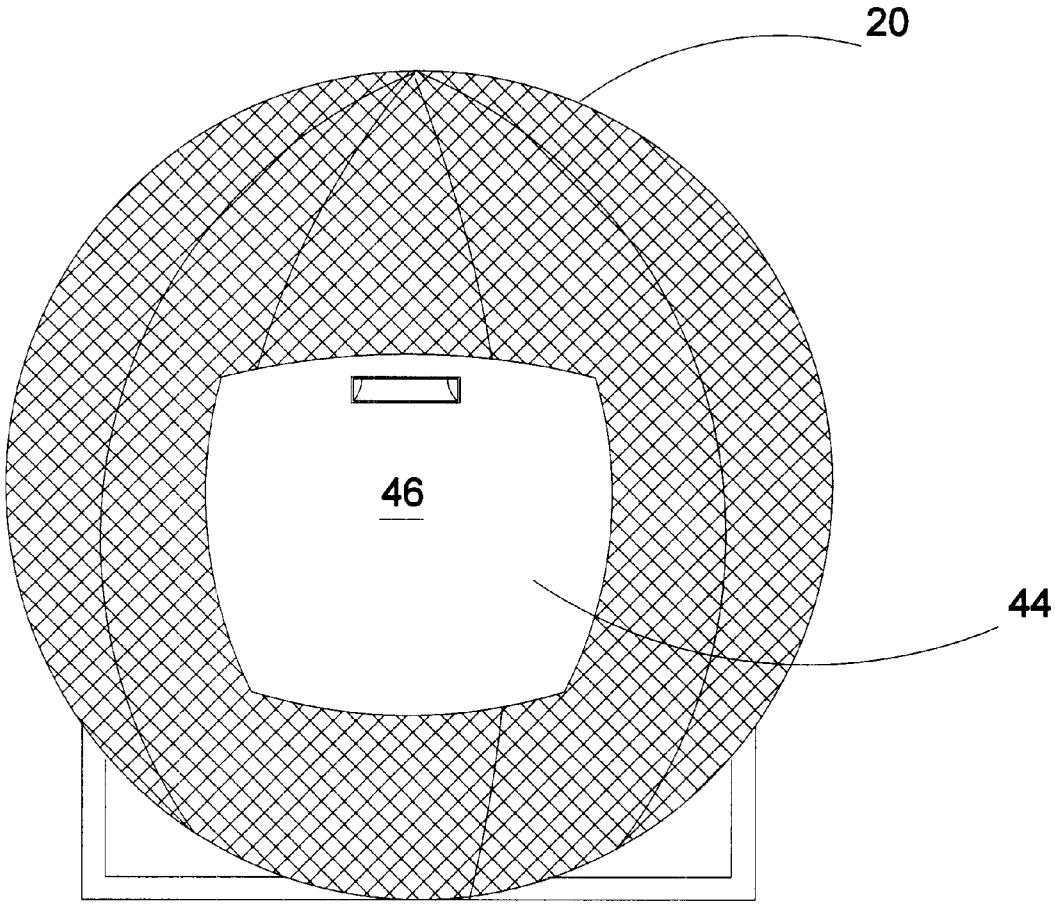
FIG. 8 is a rear view of an alternate design.

Turning to FIG. 8, shown therein is a rear view of a basket ball design bed showing the rear section of the bed and storage area 44 with lid 46.

Figure 9:
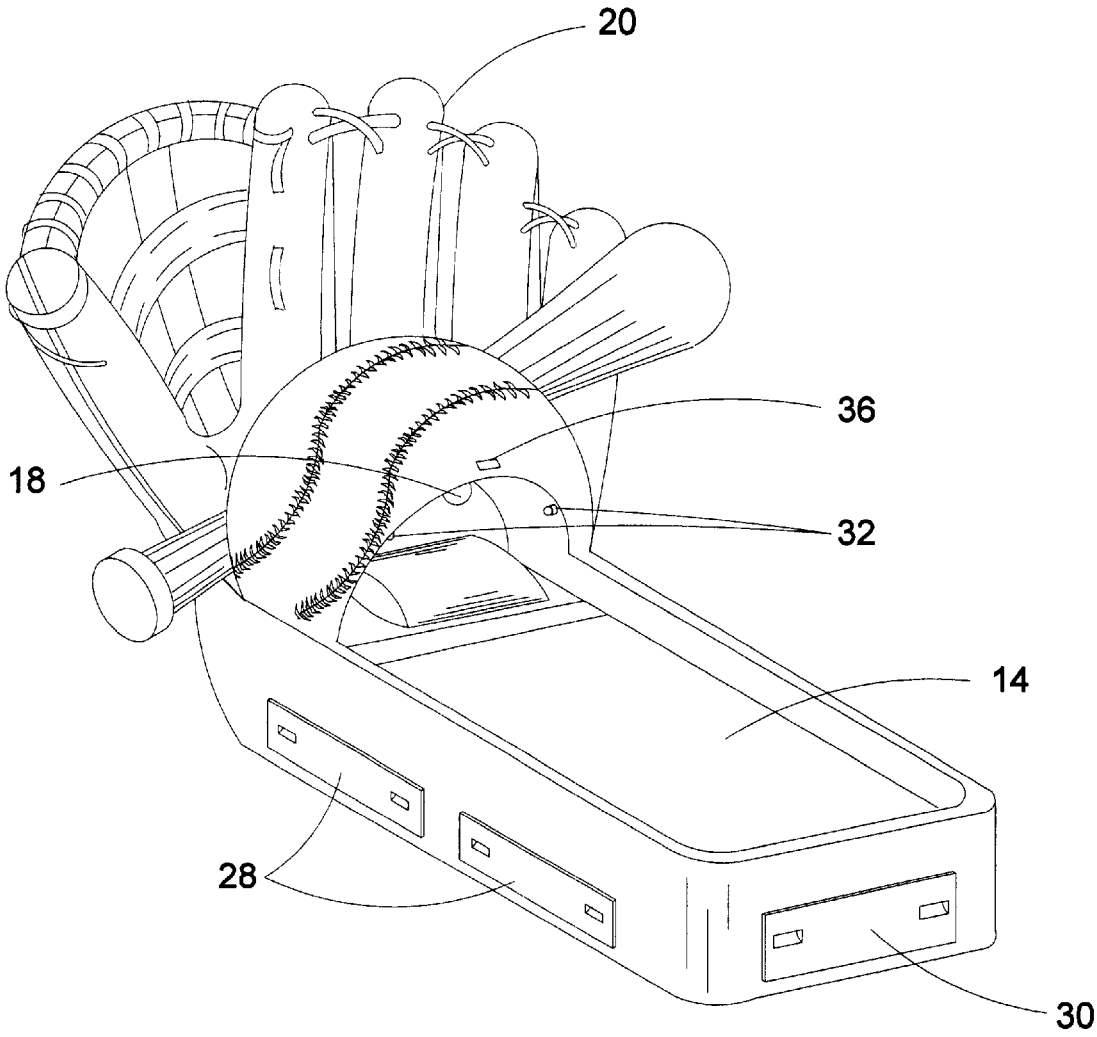
FIG. 9 is a perspective view of a baseball bed design.

Turning to FIG. 9, shown therein is a perspective view of a baseball bed design showing the mattress 14 recessed within the headboard 20 which provides a dimmer light and a sensor device 32 as previously shown. Other elements previously shown are also disclosed.

Figure 10:
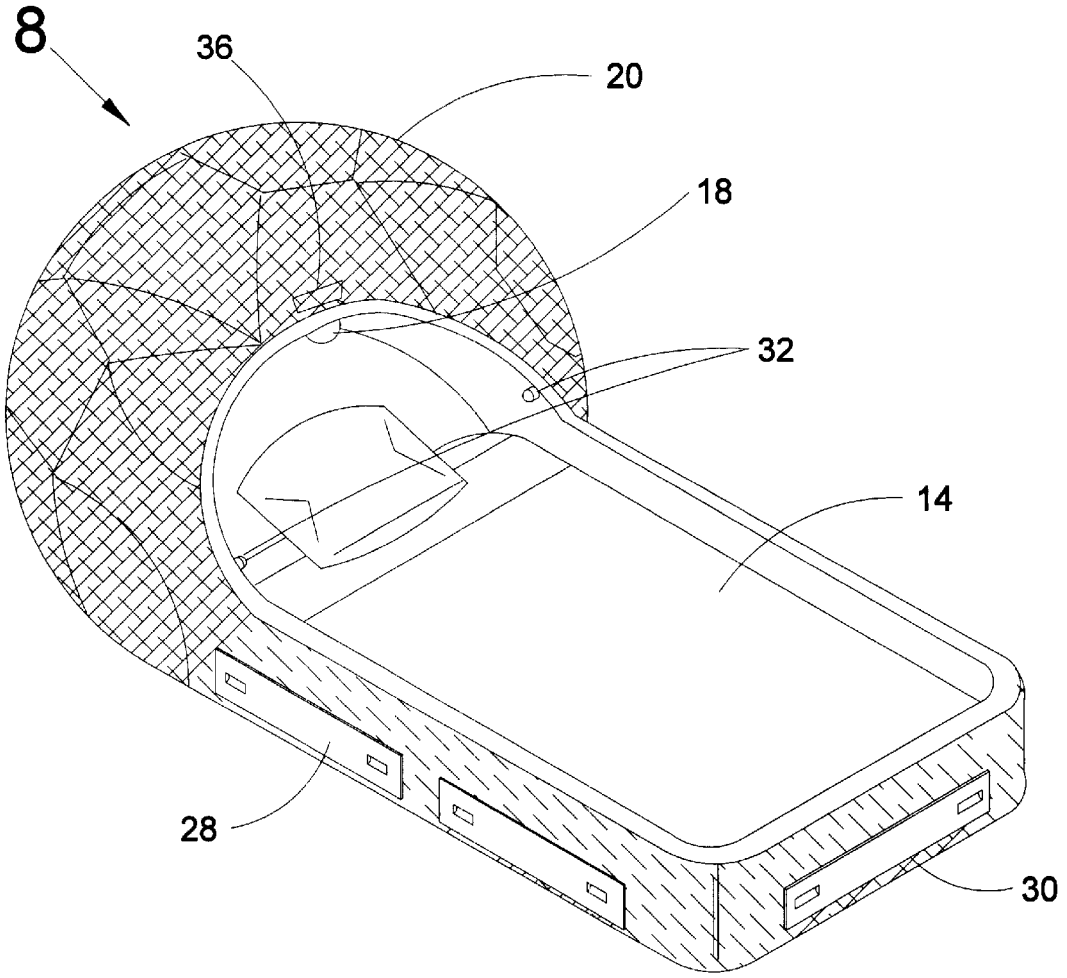
FIG. 10 is a perspective view of a soccer bed design.

Turning to FIG. 10, shown therein is a perspective view of a soccer bed design showing an alternate design for the sports bed, the design being a soccer ball. Elements previously shown are also disclosed.

What is claimed to be new and desired to be protected by Letters Patent is set forth in the appended claims:

I claim:

1. An apparatus for a bed for a user, comprising:

a) a molded bed frame, said frame containing a bed;

b) wherein said bed frame has the shape of a football, having a top side, a bottom side, a front end, a rear end, and a pair of sides, said bed frame forming an enclosure having a plurality of cavities therein, said enclosure having a plurality of support frame members internal therein;

c) a recess disposed on said top side of said bed frame, said recess being generally rectangular shaped, said recess forming a receptacle;

d) a headboard disposed on said rear end of said bed frame;

e) a mattress disposed in said recess for receiving the user, said headboard overhanging a portion of said recess including an area where a pillow is located;

f) a plurality of storage compartments disposed in said cavities of said bed frame;

g) a night light disposed on said headboard for providing light to a user, said night light located in an overhead section of said headboard over said pillow;

h) a pair of motion sensors disposed on said overhead section of said headboard facing said recess for detecting motion of the user, said sensors located on opposite side edges of said headboard with said night light between said motion sensors;

i) said motion sensors having means for controlling said lights whereby said light can be turned on and off, or, dimmed; and, j) a source of power for said night light, said motion sensors, and said means for controlling said light.

2. The apparatus of claim 1, wherein said storage compartments further comprise a plurality of drawers disposed internally within said bed frame, said drawers being slidable internal said storage compartment.

3. The apparatus of claim 2, wherein said drawers are disposed on said sides of said bed frame.

4. The apparatus of claim 3, wherein said storage compartments further comprise a toy storage box disposed on said front end of said bed frame.

5. The apparatus of claim 4, wherein said front toy storage box further comprises a lid, said lid being hingedly disposed on said bed frame.

6. The apparatus of claim 5, wherein said storage compartments further comprise a toy storage box disposed on said rear end of said bed frame.

7. The apparatus of claim 6, wherein said rear toy storage box further comprises a lid, said lid being hingedly disposed on said bed frame.

8. The apparatus of claim 7, wherein said means for controlling said light turn said light on when a user is moving in the bed.

9. The apparatus of claim 8, wherein said means for controlling said light will turn said light off when a user is immobile in the bed.

10. The apparatus of claim 9, wherein said source of power further comprises a battery, said battery located in the overhead section of said headboard and accessible from above.

11. The apparatus of claim 10, wherein said drawers are disposed on said front end of said bed frame.

12. An apparatus for a bed for a user, comprising:

a) a bed frame, said frame containing a bed;

b) wherein said bed frame is rectangular in shape, having a top side, a bottom side, a front end, a rear end, and a pair of sides, said bed frame forming an enclosure having a plurality of cavities therein;

c) a recess disposed on said top side of said bed frame, said recess being generally rectangular shaped, said recess forming a receptacle;

d) a headboard disposed at a head end of said bed frame, said headboard comprising a spherical member having the appearance of a baseball and an opening to accommodate the head end of said recess with a section overhanging said recess where a pillow is located, a bat shaped member diagonally arranged behind said spherical member, and a glove shaped member behind said bat shaped member, said headboard thereby consisting of glove, bat and baseball shaped members;

e) a mattress disposed in said recess for receiving the user;

f) a plurality of storage compartments disposed in said cavities of said bed frame;

g) a night light disposed on the overhanging section of said spherical member for providing light for a user;

h) a pair of motion sensors disposed on said overhead section of said spherical member facing said recess for detecting motion of the user, said sensors located on opposite side edges of said spherical member with said night light between said motion sensors;

i) said motion sensors having means for controlling said light whereby said light can be turned on and off, or, dimmed; and, j) a source of power for said night light, said motion sensors, and said means for controlling said light.

* * * * *